US005505345A

United States Patent [19]

Zeid

[11] Patent Number: 5,505,345

[45] Date of Patent: Apr. 9, 1996

[54] GAS SAVING DISPENSING CAP FOR A BOTTLE

[76] Inventor: Waleed A. Zeid, P.O. Box 19211, Jerusalem, Israel

[21] Appl. No.: 258,451

[22] Filed: Jun. 10, 1994

[51] Int. Cl.[6] ..... B65D 83/16

[52] U.S. Cl. ..... 222/402.1; 222/394; 222/511; 222/529; 222/464.1; 251/7

[58] Field of Search ..... 222/394, 402.1, 222/402.13, 402.15, 464, 511, 527, 528, 529, 402.21; 251/7

[56] References Cited

U.S. PATENT DOCUMENTS

| | | | |
|---|---|---|---|
| 3,882,899 | 5/1975 | Ginsberg et al. | 137/627.5 |
| 3,998,364 | 12/1976 | Hollander | 222/511 |
| 4,176,671 | 12/1979 | Citrin | 251/7 |
| 4,624,663 | 11/1986 | Danby et al. | 604/250 |
| 4,634,092 | 1/1987 | Daniell et al. | 251/7 |
| 4,759,527 | 7/1988 | Brown et al. | 251/118 |
| 5,022,565 | 6/1991 | Sturman et al. | 222/464 X |
| 5,154,704 | 10/1992 | Archibald | 604/250 |
| 5,370,283 | 12/1994 | Nelson et al. | 222/464 |

FOREIGN PATENT DOCUMENTS

| | | | |
|---|---|---|---|
| 2926221 | 1/1981 | Germany | 222/394 |

*Primary Examiner*—Joseph A. Kaufman
*Attorney, Agent, or Firm*—Ice Miller Donadio & Ryan

[57] ABSTRACT

A cap for a bottle containing a carbonated beverage provides a dispensing mechanism that prevents carbonation gas from escaping from the bottle as the beverage is being dispensed. The cap has a housing with a first end adapted to mate with a neck of the bottle and an opening out of which beverage to be dispensed flows. A valve is mounted in the housing having a first end coupled in fluid communication with the bottle when the cap is on the bottle and a second end coupled in fluid communication to an outlet in the housing. A manually operated actuator is coupled to the valve for opening and closing the valve.

9 Claims, 3 Drawing Sheets

GAS SAVING DISPENSING CAP FOR A BOTTLE

TECHNICAL FIELD

This invention relates to bottle caps, and more particularly to a bottle cap for bottles containing carbonated beverages that has a dispensing mechanism which permits carbonated liquid in the bottle to be dispensed and prevents the escape of carbonation gas from the bottle.

BACKGROUND

Large or family size bottles of carbonated soft drinks, e.g., 1.5 and 2 liter bottles, have a problem with the soft drink going flat if it is not used within a short period after the bottle is opened. Although these bottles have resealable caps, typically caps which are threaded onto a threaded neck of the bottle, each time the cap is unscrewed it allows the carbonation gas within the bottle to escape. Consequently, each time the bottle is opened, more carbonation gas is lost and if the soft drink is not used within a short period of time, it goes flat.

It is an objective of this invention to provide a reusable bottle cap for bottles containing carbonated soft drinks that has a dispensing mechanism for dispensing the soft drink and preventing the escape of the carbonation gas from the bottle.

SUMMARY OF THE INVENTION

A cap in accordance with this invention for a bottle containing a carbonated beverage provides a dispensing mechanism that prevents carbonation gas from escaping from the bottle as the beverage is being dispensed. The cap has a housing with a first end adapted to mate with a neck of the bottle and a second end having an outlet out of which beverage to be dispensed flows. A valve is mounted in the housing having a first end coupled in fluid communication with the bottle when the cap is on the bottle and a second end coupled in fluid communication to an outlet in the housing. A manually operated actuator is coupled to the valve for opening and closing the valve.

DETAILED DESCRIPTION OF THE INVENTION

Figure 1:
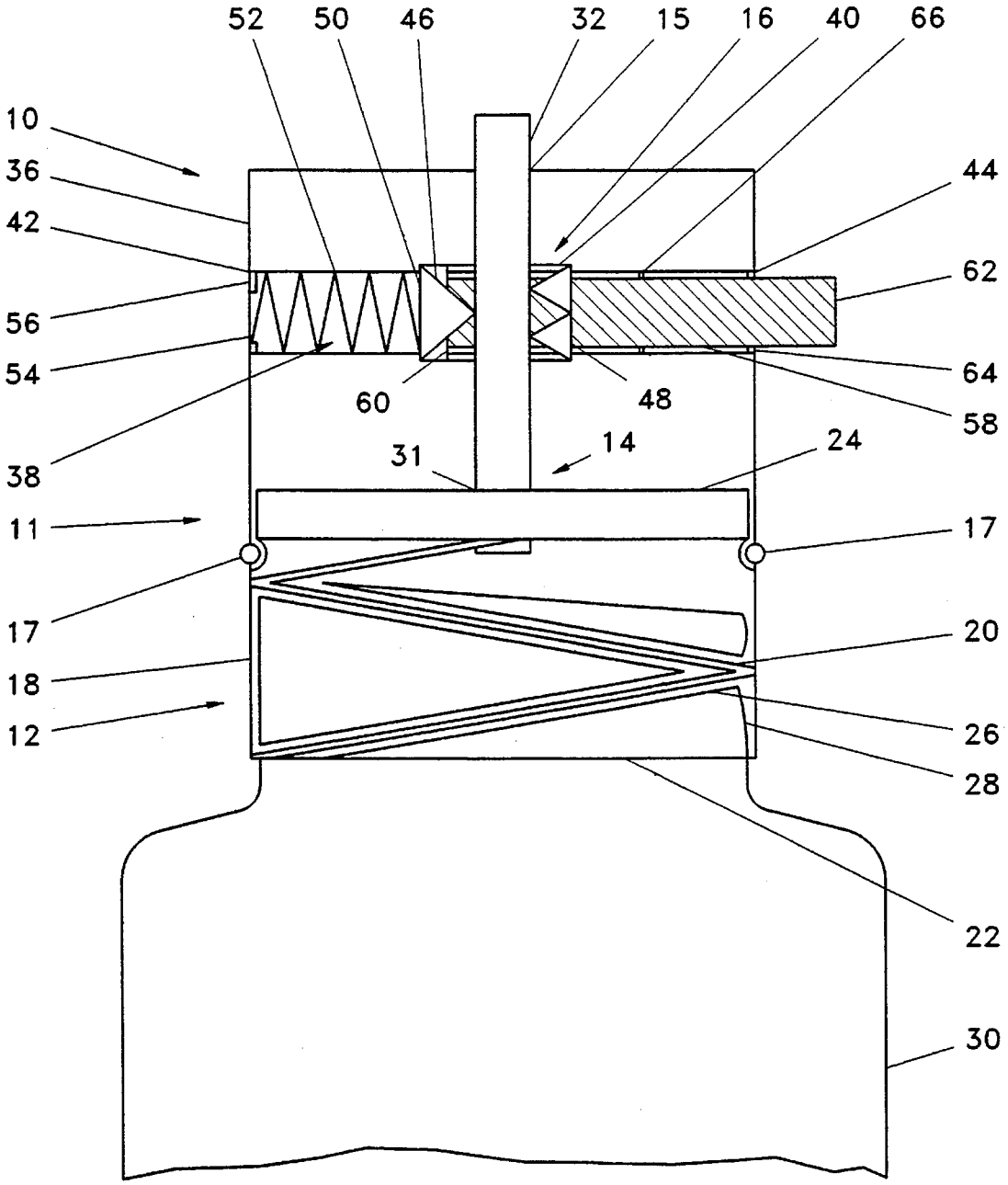
FIG. 1 is a side section of a bottle cap according to the invention.

Referring to FIG. 1, a bottle cap 10 according to the invention has a housing 11 a gasket and tube 14, and clamping device or dispensing mechanism 16. Housing 11 illustratively comprises a lower portion or screw cap 12 and an upper portion or shell 36 which are affixed together as will be described below. In the embodiment of FIG. 1, gasket and tube 14 are received in screw cap 12, as discussed below, and screw cap 12 snapped together with shell 36 which contains clamping device 16. In this regard, screw cap 12 and shell 36 are provided with a snap ring 17 which holds screw cap 12 and shell 36 together.

Screw cap 12 comprises a cylindrical shell 18 internally threaded at 20 and having an open lower end 22 and a top 24. Screw cap 12 is formed to resemble a bottle cap for a soft drink bottle, such as a two-liter soft drink bottle, so that internal threads 20 mate with the threads 26 on a neck 28 of a bottle 30 (FIG. 1). Top 24 of screw cap 12 has a hole 31 extending therethrough at generally the center thereof through which tube 32 of gasket and tube 14 extends as will be described below.

Figure 2A:
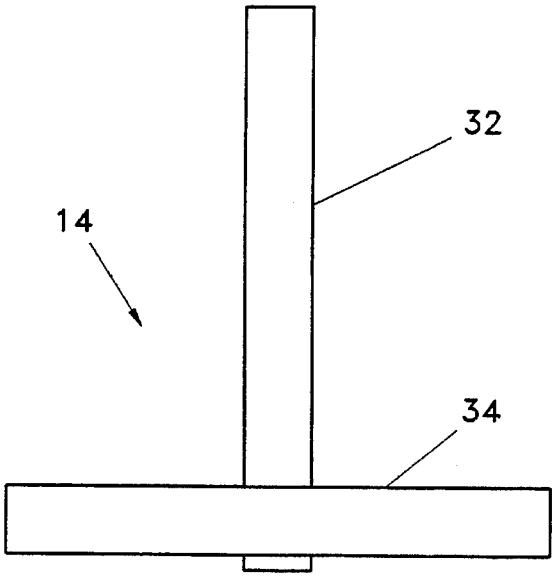
FIG. 2A is a side elevation view of the tube and gasket of FIG. 1.
Figure 2B:
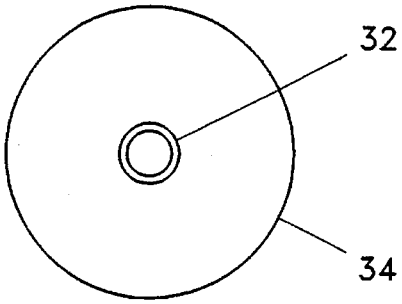
FIG. 2B is a top view of the tube and gasket of FIG. 2A.
Figure 6:
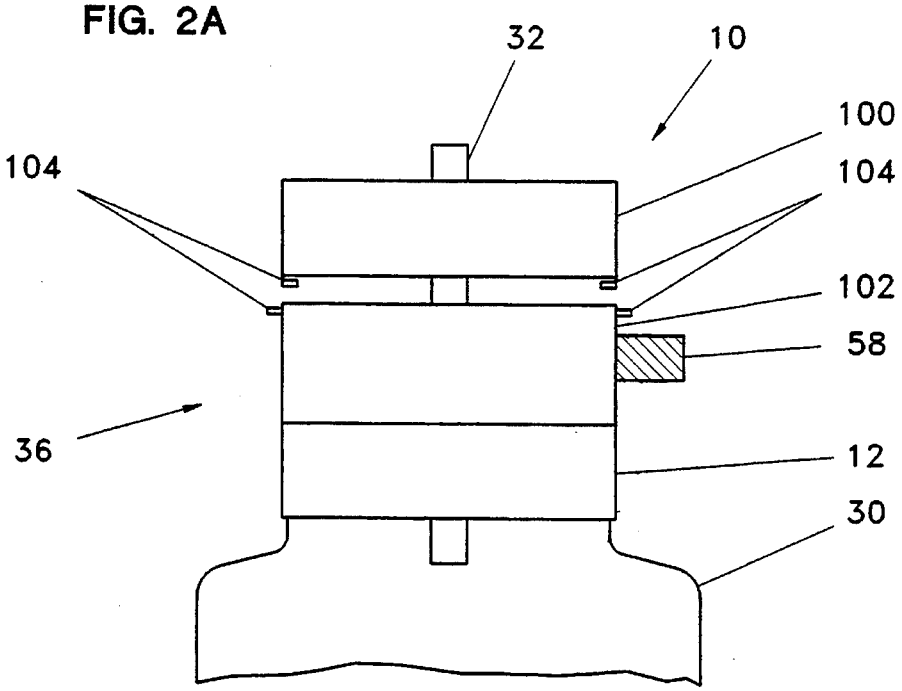
FIG. 6 is a side perspective view of the embodiment of FIG. 3 mounted on a bottle.

Referring more specifically to FIGS. 2A and 2B, gasket and tube 14 includes tube 32, which is hollow, which extends through a gasket 34, which is illustratively a disc. Tube 32 and gasket 34 are illustratively formed as one piece, such as by injection or blow molding, from a resilient material such as rubber to form gasket and tube 14. Referring to FIG. 1, gasket 34 fits within screw cap 12 and abuts against the lower surface of top 24 of screw cap 12 so that tube 32 extends upwardly through hole 31 in top 24.

When screw cap 12 and shell 36 are affixed together, tube 32 extends up through shell 36 and out through an outlet 15 in the top of shell 36. Shell 36 also has a channel 38 extending transversely therethrough which intersects tube 32 when screw cap 12 is attached to shell 36. Channel 38 has first and second ends 42, 44 at opposite sides thereof and an expanded mid-portion 40 through which tube 32 extends. Located within expanded mid-portion 40 of channel 38 is clamping device 16. Clamping device 16 coacts with tube 32 to provide a valve through which carbonated beverage is dispensed as will be evident from the discussion below. Clamping device 16 illustratively comprises a moveable tooth 46 and fixed teeth 48 opposite sides of tube 32, a spring 52 and a plunger 58. Moveable tooth 46 abuts and is illustratively affixed to a proximal end 50 of the spring 52. Spring 52 extends in channel 38 between mid-portion 40 of channel 38 to first end 42 of channel 38. First end 42 of channel 38 may open through shell 36 in which case a stop 56 is provided at first end 42 of channel 38 against which a distal end 54 of spring 52 abuts. Illustratively, stop 56 can be formed as part of shell 36 by making the diameter of first end 42 of channel 38 smaller than the diameter of channel 38. Alternatively, first end 42 of channel 38 ends at an inner surface of shell 36 so that channel 38 does not extend through shell 36 at its first end 42 so that the inner surface of shell 36 acts as the stop 56.

Plunger 58 is also received in channel 38 and has a distal end 60 which abuts, and is illustratively affixed to moveable tooth 42. Plunger 58 has a proximal end 62 which extends through shell 36 at the second end 44 of channel 38. A stop 64 is provided at the second end 44 of channel 38 and a corresponding stop tab 66 is affixed to plunger 58.

In operation, screw cap 12 of bottle cap 10 is screwed onto the neck 28 of bottle 30 (FIG. 1). When soft drink in bottle 30 is not being dispensed, spring 52 of clamping device 16 urges movable tooth 46 of clamping device 16 toward fixed teeth 48 of clamping device 16 to pinch tube 32 shut. This prevents carbonation gas from escaping from bottle 30.

When it is desired to dispense soft drink from bottle 30, bottle 30 is tilted so that the soft drink flows into screw cap 12 and covers gasket 34 of gasket and tube 14. The proximal end 62 of plunger 58 is then depressed, which forces movable tooth 46 of clamping device 16 back against spring 52, compressing spring 52 and opening tube 32. Soft drink now flows out of bottle 30 through tube 32. When the desired amount of soft drink has been dispensed from bottle 30, plunger 58 is released. Spring 52 then urges moveable tooth 46 back against fixed teeth 48, pinching tube 32 shut. Bottle 30 is then returned to the upright position.

During dispensing, bottle 30 is tilted so that soft drink covers the opening to tube 32 in gasket 34. Consequently, when plunger 58 is depressed to open tube 32, the liquid soft drink covering the opening to tube 32 in gasket 34 prevents the carbonation gas from escaping through tube 32. By releasing plunger 58 before returning bottle 30 to the upright position, liquid soft drink remains covering the opening to tube 32 in gasket 34 at all times when tube 32 is opening. Thus, the carbonation gas is prevented from escaping which prevents the soft drink in bottle 30 from going flat.

Figure 5:
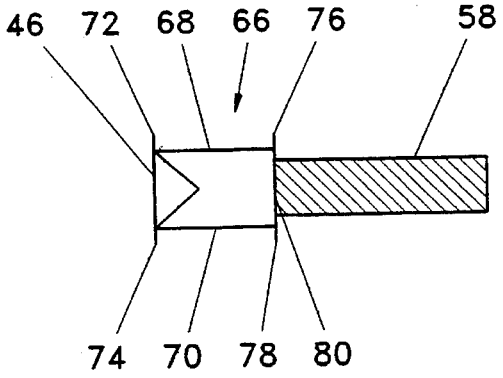
FIG. 5 is a top view of a plunger assembly used in the embodiment of FIG. 3.

FIGS. 3–6 show an embodiment of the invention where the moveable tooth 46 and fixed teeth 48 are mounted in a horizontal orientation in shell 36. Like elements to the embodiment of FIGS. 1 and 2 are numbered with like reference numerals. Referring more particularly to FIG. 5, plunger 58 and moveable tooth 46 are part of a plunger assembly 66. In plunger assembly 66, moveable tooth 46 and plunger 58 are affixed in spaced relation to each other by spaced apart rails 68, 70. Plunger assembly 66 further includes opposed tabs 72, 74 extending laterally outwardly from rails 68, 70 at a base of moveable tooth 46 and 21 opposed tabs 76,78 extending laterally outwardly from rails 68, 70 at a junction 80 where plunger 58 is joined to rails 68, 70.

Figure 3:
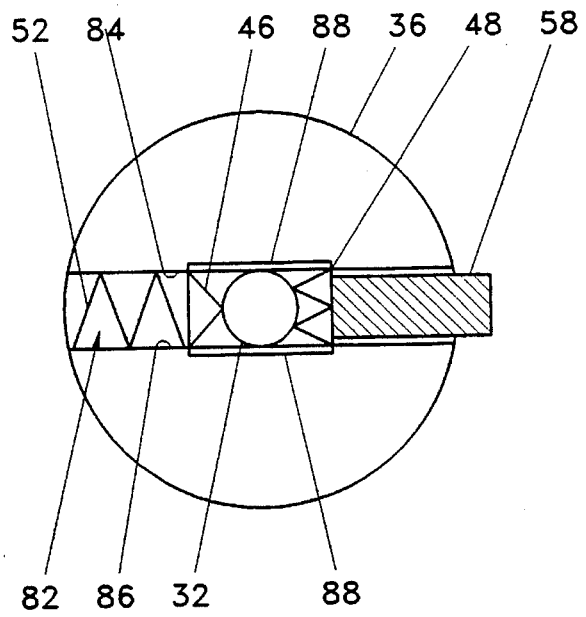
FIG. 3 is a top sectional view of an embodiment of a bottle cap according to the invention.
Figure 4:
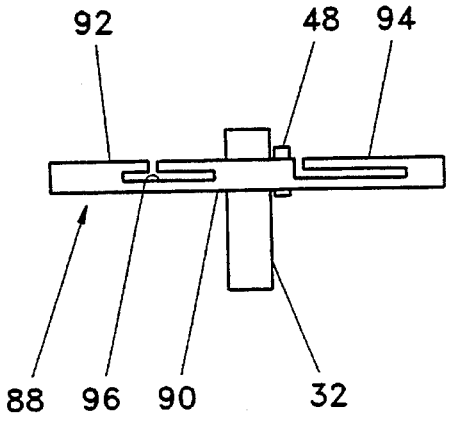
FIG. 4 is a side view of a race used in the embodiment of FIG. 3.

Shell 36 has a horizontally oriented channel 82 extending therethrough with sidewalls 84, 86 on either side of channel 82 (FIG. 3). Races 88 are affixed in sidewalls 84, 86 at generally the middle of channel 2. As shown more particularly in FIG. 4, each race 88 comprises a longitudinally extending rail 90 having first and second segments 92, 94. First segment 92 has a first generally T-shaped slot 96 formed therein and second segment 94 has a generally L-shaped slot 98 formed therein wherein slots 96, 98 are on opposite sides of tube 32. Fixed teeth 48 are mounted in channel 82 on a first side of tube 32 (FIG. 3). Plunger assembly 66 is placed in channel 82 so that the open space defined by rails 68, 70 surrounds fixed teeth 48 and tube 32 (as shown in connection with FIGS. 3 and 5). Tabs 72, 74 are received in T-shaped slots 96 of races 88 and tabs 76, 78 are received in L-shaped slots 98 of races 88.

Races 88 may illustratively be formed integral with sidewalls 84, 86. To facilitate assembly of plunger assembly 46 and fixed teeth 48 into channel 82, shell 36 can be formed as two pieces, such as top piece 100 and bottom piece 102 (FIG. 6) so that when the pieces 100, 102 are apart, channel 82 is exposed. In this regard, top and bottom pieces 100, 102 are provided with fitting tabs 104 to secure them together.

As discussed with the embodiment of FIGS. 1 and 2, spring 52 urges moveable tooth 46, and in the embodiment of FIGS. 3–6, plunger 22 assembly 66, toward tube 32 to pinch tube 32 against fixed teeth 48 thus pinching tube 32 shut. When it is desired to dispense soft drink, plunger 58 is depressed, forcing moveable tooth 46 away from fixed teeth 48. As bottle 10 is titled before depressing plunger 58 so that the inlet to tube 32 is covered with soft drink, carbonation gas is prevented from escaping from bottle 10 when soft drink is being dispensed.

While presently preferred embodiments and other less preferred embodiments of the invention are described above, those skilled in the art will recognize that other embodiments are possible without departing from the scope of the following claims.

What is claimed is:

1. A cap for a hollow bottle having an interior containing a carbonated beverage for dispensing the carbonated beverage and reducing the excape of carbonation gas when the carbonated beverage is being dispensed while the bottle is being tilted, said bottle having a neck portion surrounding an opening to the interior of said bottle, comprising:

a. housing having a first end adapted to mate with and seal against the neck portion of the bottle to cover said opening;

b. a valve mounted in the housing and including a channel having an inlet and a outlet, said valve operable to close said channel, said inlet being in fluid communication with the interior of said bottle when the cap is on the bottle and said channel providing a fluid path to said outlet when said channel is open; and c. a manually operated actuator coupled to the valve for opening the valve when manually actuated to allow beverage to flow through the channel and out of the outlet when beverage is being dispensed and for closing the valve when manually released to substantially hinder beverage from flowing out of the outlet and reduce the escape of carbonated gas from said bottle wherein the carbonated beverage covers the inlet of the channel and the carbonated beverage flows through said channel to the outlet only when said bottle is tilted and the valve is manually actuated.

2. The cap of claim 1 wherein the channel comprises a resilient hollow tube and said valve comprises a clamp for constricting and unconstricting the tube to allow beverage to flow through the tube when the tube is unconstricted and to constrict the tube to close the valve, the actuator coupled to the clamp to cause the clamp to constrict and unconstrict the tube in response to manual operation of the actuator.

3. The cap of claim 2 wherein the clamp comprises first and second opposed clamping members mounted in the housing on opposite sides of the tube, at least one of the clamping members movable to and away from the other clamping member, the clamp further including a spring mounted in the housing and coupled to the movable clamp member for urging the movable clamp member into the other clamp member to constrict the tube, the actuator coupled to the movable clamping member to move the movable clamp member away from the other clamp member to unconstrict the tube in response to the manual application of pressure to the actuator.

4. The cap of claim 3 wherein the housing includes a second channel extending transversely therethrough and intersecting the tube; the movable clamp member comprising at least one tooth reciprocally received in the second channel on a first side of the tube; the spring received in the second channel on the first side of the tube and having a proximal end coupled to the movable tooth and a distal end abutting a stop affixed at the end of the second channel; the other clamp member comprising at least two teeth affixed to the housing in the second channel on a second side of the tube opposite the first side of the tube; the actuator comprising a plunger received in the second channel and having a proximal end extending radially outward from a second opening in the housing and a distal end coupled to the movable tooth.

5. The cap of claim 4 wherein the hollow tube extends through a gasket, and the hollow tube and gasket are formed as one piece from resilient material.

6. The cap of claim 3 wherein the housing comprises an upper cylindrical shell and a lower hollow cylindrical shell; the lower shell having a lower open end and having internal threads formed therein adapted to threadably engage threads on a neck of the bottle, the lower shell having a top with an opening extending therethrough; the first and second clamping members, the spring and actuator mounted in the upper shell, the upper shell having a top with an opening therein comprising the outlet of the housing; the hollow tube having an annular disc attached at one end in sealing engagement therewith, the annular disc received in the lower shell against a lower surface of the top of the lower shell wherein the hollow tube extends axially upward through the opening in the top of the lower shell into the upper shell and out through the outlet of the housing; the hollow tube and annular disc formed of a resilient material wherein the annular disc provides a gasket for sealing the lower shell to the neck of the bottle when the lower shell is threaded onto the neck of the bottle and tightened.

7. The cap of claim 6 wherein the upper shell includes a second channel extending transversely therethrough and intersecting the tube and having first and second ends on opposed sides of the upper shell; the movable clamp member comprising at least one tooth reciprocally received in the second channel on the first side of the tube; the spring received in the second channel on the first side of the tube and having a proximal end coupled to the movable tooth and a distal end abutting a stop affixed to the upper shell in the second channel at the first end of the second channel; the other clamp member comprising at least two teeth affixed to the housing in the second channel on an opposed side of the tube; the actuator comprising a plunger received in the second channel and having a proximal end extending radially outward from the second end of the second channel through a second opening in the upper shell and a distal end coupled to the movable tooth.

8. A cap for a bottle containing a carbonated beverage for dispensing the carbonated beverage and preventing the escape of carbonation gas, comprising:

a. an upper, generally cylindrical shell having a first opening therein and a lower end;

b. a lower, hollow generally cylindrical shell mated with the upper shell and having internal threads therein and an open lower end into which a threaded neck of the bottle is received for threadably engaging the internal threads of the lower shell, the lower shell having a top with an opening extending therethrough;

c. an annular disc received in the lower shell against a lower surface of the top of the lower shell wherein a hollow tube extends axially upwardly through the opening in top of the lower shell into the upper shell and out through the first opening in the upper shell;

d. the upper shell having a channel extending transversely therethrough which intersects the tube, the channel having first and second opposed ends at opposite sides of the upper shell;

e. a movable clamp member received in the channel on a first side of the tube for reciprocal movement therein toward and away from the tube;

f. a spring received in the channel and extending between the movable clamp member and the first end of the channel wherein a stop is affixed to the upper shell in the channel against which a distal end of the spring abuts, the spring having a proximal end which abuts the movable tooth, g. a second clamp member affixed to the upper shell in the channel on a side of the tube opposite to the movable clamp member;

h. a plunger received in the channel and having a proximal end extending radially outward from the upper shell at the second end of the channel through a second opening in the upper shell, the plunger having a distal end coupled to the movable clamp member;

i. the spring urging the movable clamp member into the second clamp member to constrict the tube to seal the tube preventing the escape of carbonation gas from the bottle;

j. the plunger urging the movable clamp member against the spring and away from the second clamp member to unconstrict the tube upon the application of manual pressure to the plunger to permit beverage to flow out of the bottle through the tube; wherein k. when beverage is being dispensed from the bottle, the bottle is tipped so that beverage covers the annular disc in the lower shell and manual pressure is thereafter applied to the plunger to dispense the beverage, the manual pressure being released before the bottle is moved to an upright position so that beverage covers the annular disc when the tube is unconstricted which prevents the escape of carbonation gas when the beverage is being dispensed.

9. The cap of claim 8 wherein the hollow tube and annular disc are formed as one piece from the resilient material.

* * * * *